US006491588B1

(12) United States Patent
Mansfield et al.

(10) Patent No.: US 6,491,588 B1
(45) Date of Patent: Dec. 10, 2002

(54) UPPER CASE HOUSING SUPPORT TOWER FOR MARINE STERN DRIVE UNIT

(76) Inventors: Aaron Christopher Mansfield, 4199 Highland Ave., Lake Havasu, AZ (US) 86406; Jason Andren Mansfield, 3989 Brookside Dr., Lake Havasu, AZ (US) 86406

( * ) Notice: Subject to any disclaimer, the term of this patent is extended or adjusted under 35 U.S.C. 154(b) by 0 days.

(21) Appl. No.: 09/678,154

(22) Filed: Oct. 2, 2000

Related U.S. Application Data

(60) Provisional application No. 60/164,204, filed on Nov. 9, 1999.

(51) Int. Cl.[7] ..... F16D 3/84
(52) U.S. Cl. ..... 464/178; 440/78
(58) Field of Search ..... 464/7, 178, 902; 440/49, 78, 83; 248/640, 664, 672

(56) References Cited

U.S. PATENT DOCUMENTS 1,289,143 A * 12/1918 Fisher ..... 464/178 X
1,602,022 A * 10/1926 Hetland ..... 464/7 X
5,112,259 A * 5/1992 McElroy, Jr. et al. ..... 440/83
5,302,207 A * 4/1994 Jurcisin ..... 404/94 X
5,694,672 A * 12/1997 Perin
6,254,443 B1 * 7/2001 Payne ..... 440/83

FOREIGN PATENT DOCUMENTS

SU 1740248 A1 * 6/1992 ..... 440/78

OTHER PUBLICATIONS

Machinery's Handbook, 25th ed., New York, International Press, 1996, pp. 411 & 412, TJ151.M3 1996.*

* cited by examiner

*Primary Examiner*—Greg Binda
(74) *Attorney, Agent, or Firm*—Gregory J. Nelson

(57) ABSTRACT

A support for the vertical drive shaft of a marine stem drive unit. The support is a generally tubular member of high quality steel or steel alloy which is threaded at its lower end. The upper end carries an external flange. The upper end defines an internal taper which receives a bearing assembly. The flange is secured in the unit by a fastener and the threaded lower end is secured by a retainer such as a spanner nut. The drive shaft extends within the support substantially increasing the horsepower capacity of the unit by several times.

4 Claims, 2 Drawing Sheets

UPPER CASE HOUSING SUPPORT TOWER FOR MARINE STERN DRIVE UNIT

This application is based on Provisional Application Serial No. 60/164,204, filed Nov. 9, 1999, entitled: "Uppercase Housing Support Tower For Marine Drive Unit".

FIELD OF THE INVENTION

The present invention relates to a power transmission system and more particularly relates to a drive shaft support for the upper case housing of a marine stem drive unit.

BACKGROUND OF THE INVENTION

Stem drives for boats are well known and are popular with boat enthusiasts. Typical of these are the units manufactured by Mercury Marine and OMC. The stem drive unit generally consists of the upper gear housing which is adapted to mount on the transom of a boat for pivotal movement about a generally vertical steering axis. The unit also pivots about a generally horizontal pivot axis so the unit may be lifted out of the water. A drive shaft is supported by the upper gear housing and is driven by a drive shaft and U-joint assembly connected to the engine which is normally located within the rear of the boat. A lower gear housing is attached to the lower end of the upper gear housing. A propeller shaft is supported in bearings in the lower gear housing is driven by the vertical drive shaft through a lower gear set.

One problem with stern drive units of the general type described above is that the transmission provided by the manufacturers of such units are limited in their power transfer capacity. It the boat owner wishes to modify or replace the marine engine increasing its performance and horsepower, the transmission may be incapable of transmitting the increased horsepower to the propeller shaft without damage to the transmission. Often the damage occurs to the drive shaft as increased load on the drive shaft will cause it to fail. Such a failure can be very expensive to repair and may result in damage to other engine components.

As a result, boat enthusiasts have been seeking ways to modify the transmission of stern drive units so that such units can handle increased power. Generally approaches have been to increase the bearing capacity and other similar modifications which generally have not proven successful and which are expensive and further require substantial modification to the stern drive unit.

In view of the foregoing, there exists a need for an improved or modified stern drive unit which will accomodate increased engine power and which can be provided both as an original equipment manufactured item or an market unit.

BRIEF SUMMARY OF THE INVENTION

Briefly, the present invention provides a support for the vertical drive shaft of a stern drive unit. The support includes a generally axially extending tubular member having external threads at its lower end. The upper end supports a flange having a bore for a set screw. Additional bores may be provided as an oil transfer location or may also receive a mounting set screw. The tubular member has a taper at its upper end which extends partway into the axial bore. A bearing member, such as a roller or needle bearing, is pressed or otherwise secured within the upper end of the tubular member. The drive shaft support is inserted into a stern drive unit by removing the top cover to provide access to the vertical shaft. The vertical drive shaft is removed and the support is inserted from the top. When inserting the support, the lower threaded end is secured by tightening a retainer, such as a spanner nut, about threads which retainer will engage the housing structure.

The upper end of the support is secured by inserting a fastener, such as a set screw, through one of the bores in the flange with the set screw engaging a component or structure of the upper drive shaft housing. The drive shaft and other components such as the U-joint assembly, top cover and the like can then be attached completing the installation. The drive shaft extends through the support and is coupled to the upper shaft which carries the clutch and gearing. Housing the drive shaft within the drive shaft support will increase the capacity of the drive shaft by a factor of up to three. Preferably the support is fabricated from a high quality stainless steel or chrome moly steel such as 4140 or 4130.

BRIEF DESCRIPTION OF THE DRAWINGS

The above and other objects of the present invention will be better understood from the following description and claims in which:

DETAILED DESCRIPTION OF THE INVENTION

Figure 1:
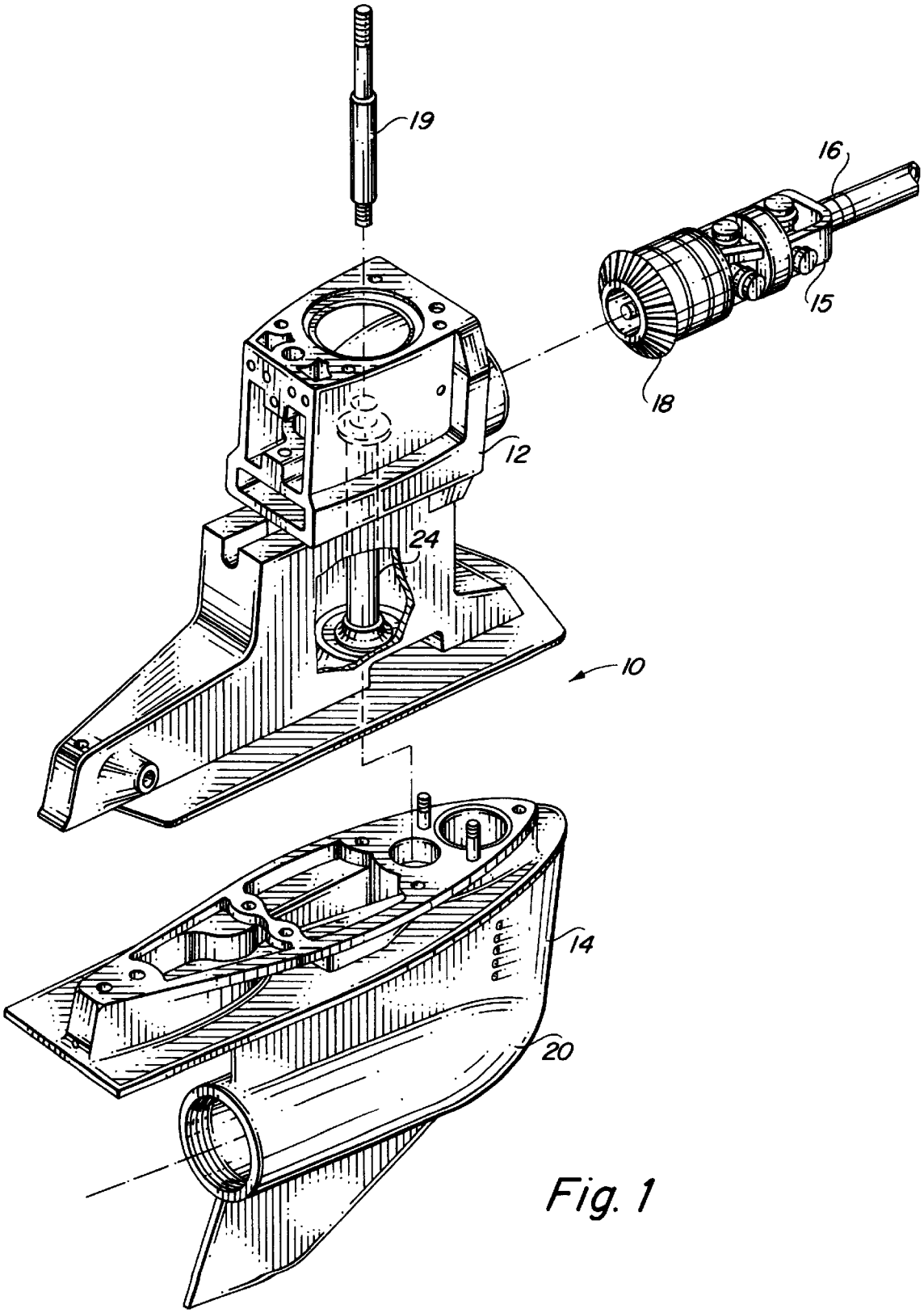
FIG. 1 is an exploded view showing the basic components of a stern drive unit and the position of the drive shaft support of the present invention.

Turning now to the drawings, a stern drive unit 10 is shown in FIG. 1. The stern drive unit 10 is representative of those of the type manufactured by Mercury Marine and OMC. Stern drive units 10 of this type have an upper gear housing 12 which is adapted to be mounted on the transom of a boat at a bracket, not shown. The upper gear housing 12 along with the lower gear housing 14 are pivotal about a generally vertical axis in order to steer the craft. The stern drive unit is also vertically pivotal so that it may be tilted to a position out of the water when not in use or for service or inspection. A U-joint assembly 15 has a shaft 16 which is coupled to an engine within the boat, not shown. The outer end of the U-joint assembly is provided with a bevel gear 18 which, through a clutch assembly and upper shaft imparts rotation to vertically extending drive shaft 19. The drive shaft 19 when installed is coupled to an upper drive shaft 20 which is driven by the U-joint shaft 16.

The lower end of the drive shaft 19 is received within the lower gear housing 20 which, as mentioned above, is affixed to the upper gear housing for common movement therewith. A propeller shaft, not shown, extends along the propeller shaft axis indicated by the dotted line. The outer end of the propeller shaft carries a propeller with the propeller shaft being rotatably by gear on the lower end of the vertical drive shaft which engage a gear set on the propellor shaft.

The vertical drive is held in place by bearing located along the shaft such as thrust and needle bearings.

As indicated above, the conventional drive arrangement is adequate in many instances but is insufficient for applications where the marine engine is a high performance engine, as for example above-horsepower. Accordingly, the present invention provides a drive shaft support which can be readily positioned within the upper drive shaft housing and which will support the vertical drive shaft to allow the stern drive to transmit greater horsepower to the propellor.

Figure 2:
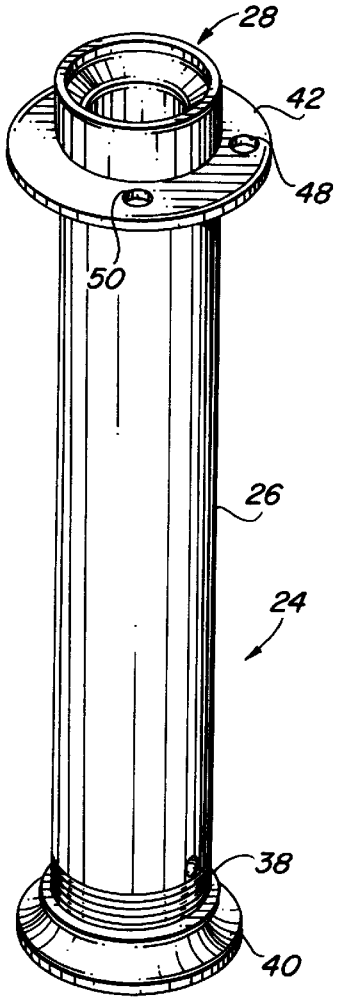
FIG. 2 is a perspective view of the drive shaft support of the present invention.
Figure 4:
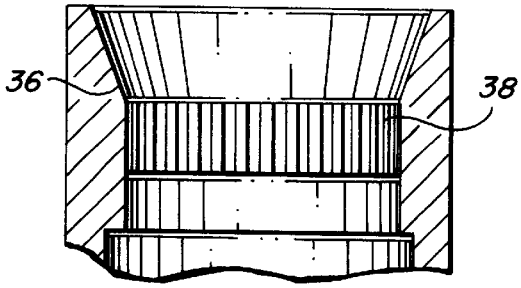
FIG. 4 is a cross-sectional view of the upper end of the shaft support showing the patered upper end of the shaft and the bearings and upper drive shaft assembly.
Figure 5:
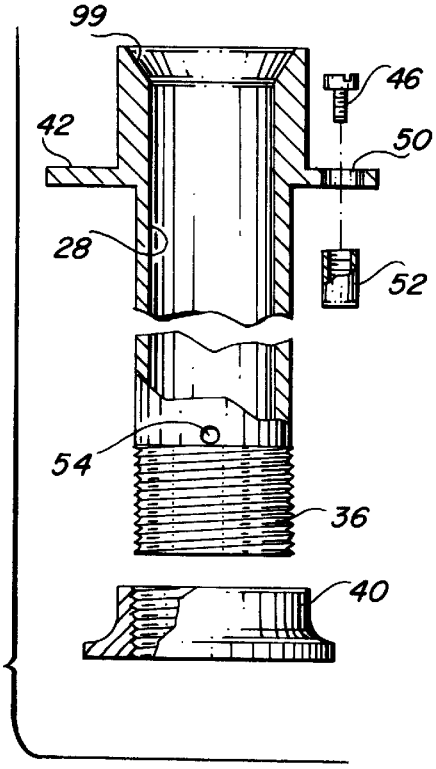
FIG. 5 is an exploded perspective view of the support.

Turning to FIG. 2 and 4, the support 24 has an axilly extending shaft tube 26 which defines an axilly extending bore 28. The length and inner and outer diameters of the shaft tube are selected in accordance with the physical dimensions of the drive unit in which the shaft support is to be installed. Typically for installation in drive units such as a Bravo 1, 2 or 3, manufactured by Brunswick Corporation, the outer diameter of the tube will be 1.450"to 1.800"and the overall length 10.250"–10.750".

The outer diamere 99 of the upper end of the tube is machined to accept the caged needle bearing race in the bottom gear of the upper drive shaft assembly therefore providing support for both the drive shaft and the upper drive shaft assembly.

As best seen in FIG. 4, the upper end of tube 26 is provided with an internal tapered section 30 which extends to a shoulder 36. A bearing assembly 39, such as ball bearings, or as shown, needle bearings or caged needle bearings, are pressed into the shoulder area to receive and support the outer diameter of the inserted drive shaft 19.

The lower end of the axially extending tube 26 is provided with external threads 38. A retainer shown as spanner nut 40 is threaded and is engageable with the threads 38 so that when the tube is inserted into position in the upper housing, as shown in FIG. 1, it is secured at its lower end by engaging the spanner nut about the threads and tightening it until the spanner nut engages internal structures such as a surface of the upper drive housing.

Figure 3:
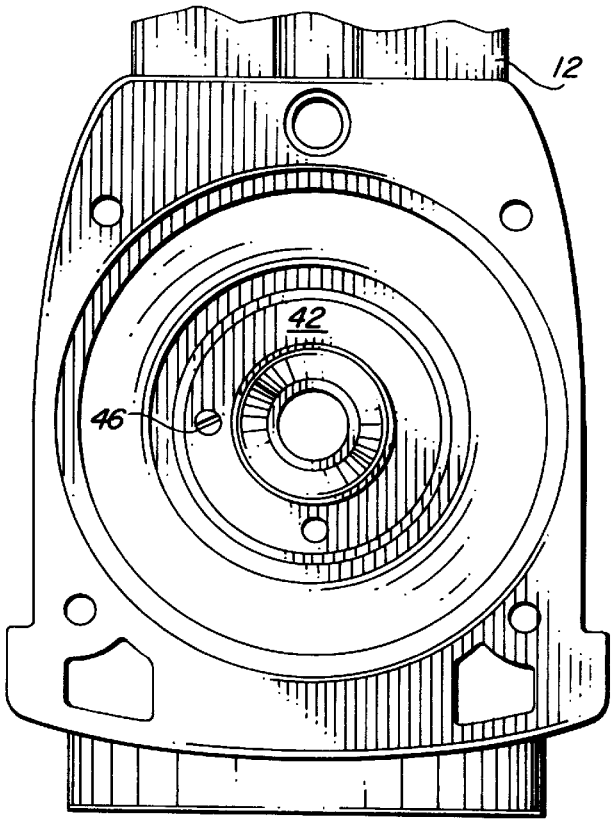
FIG. 3 is a top view of the upper drive shaft housing showing the support of the present invention in an installed position.

A circular flange 42 is spaced from the upper end of the tube and is located to seat on a surface of the upper drive shaft housing as shown in FIG. 3. The support is secured against rotation by means of a retainer, such as set screw 46, which extends within a bore in the flange. An additional bore 50 may be provided in the flange which may also receive a threaded set screw insert 52 which may serve as a lubrication transfer port. Additional oil ports 54 may also be provided at locations along the tube. Once in position, the re-assembly is completed by inserting the vertical drive shaft into the support, connecting the U-joint assembly to the drive shaft via the upper shaft and replacing other components including the cover unit. When installed, the vertical drive shaft support will allow use of higher performance or higher rated marine engines.

As mentioned above, the shaft support housing can be an original equipment item installed by the factory or a retrofit item. The particular dimensions will be selected in accordance with the physical dimensions of the marine engine in which the support is to be installed. The retrofit or after-market installation also is a relatively simple procedure which requires removal of the cover of the upper drive shaft. Disassembly also includes removal of the drive shaft and U-joint assembly. Thereafter, the shaft support 24 can be installed in the upper drive shaft housing as described above. The installation should require only three cuts to the surrounding case housing upper. The unit is secured by the upper set screw and the lower spanner which cooperate with existing structure within the upper drive shaft housing.

Test on a stern drive unit, such as a Bravo, have demonstrated the effectiveness of the support. The conventional factory unit will accommodate up to 400 horsepower. The factory unit was modified by installing a support unit of the type described having the following dimensions:

1.450" to 1.800" diameter 10.250" to 10.750" length

The resulting modification increased the capacity of the drive permitting the engine horsepower to be increased by as much as 650 horsepower at a cost substantially less than an equivalent larger capacity drive unit.

It will be obvious to those skilled in the art to make various changes, alterations and modifications to the invention described herein. To the extent such changes, alterations and modifications do not depart from the spirit and scope of the appended claims. They are intended to be encompassed therein.

We claim:

1. A support for the drive shaft, upper gear, clutch and bearing assembly of a marine stern drive unit of the type having an upper gear housing and a lower gear housing, said support comprising:

(a) a generally elongate tube defining an axially extending bore, said tube having an upper end and a lower end and mountable in the upper gear housing and having a length extending from the upper gear housing to the lower gear housing;

(b) a flange extending about said tube adjacent the upper end thereof and having mounting means for securement in the upper gear housing;

(c) said upper end of said bore being tapered;

(d) bearing members disposed adjacent said taper to support the drive shaft and upper gear and clutch assembles;

(e) said tube having external threads at the lower end thereof; and (f) retainer means threadably engaged with said threads, said retainer means being located in said lower housing and securable against said upper housing to secure the support in a fixed position.

2. The support of claim 1 wherein said tube is selected from the group of materials consisting of stainless steel or chrome moly steel.

3. The support of claim 1 further including a lubrication port in said flange.

4. The support of claim 1 wherein said flange includes a set screw to prevent rotation thereof.

* * * * *